United States Patent [19]

Rankin

[11] 4,111,616

[45] Sep. 5, 1978

[54] FLEXIBLE WALL PUMP

[76] Inventor: Andrew Francis Rankin, Pannoo Rd., Lockington, Victoria, Australia

[21] Appl. No.: 742,525

[22] Filed: Nov. 16, 1976

[51] Int. Cl.[2] ..... F04B 45/00; F04B 11/00

[52] U.S. Cl. ..... 417/472; 417/480; 417/541

[58] Field of Search ..... 417/430, 480, 413, 481, 417/541; 92/90

[56] References Cited

U.S. PATENT DOCUMENTS

| | | | |
|---|---|---|---|
| 16,373 | 1/1857 | Burnham | 417/541 |
| 119,996 | 10/1871 | Randall | 417/480 |
| 154,149 | 8/1874 | Paget | 417/480 |
| 348,361 | 8/1886 | Van Order | 417/480 |
| 562,285 | 6/1896 | Delpeyrou | 417/480 |
| 1,538,166 | 5/1925 | Cass | 92/90 |
| 1,610,473 | 12/1926 | Reybold, Jr. et al. | 417/480 |
| 2,748,606 | 6/1956 | Cornelius | 417/413 |

*Primary Examiner*—William L. Freeh

*Attorney, Agent, or Firm*—Haseltine, Lake & Waters

[57] ABSTRACT

A sludge pump which includes successive inlet, work and outlet chambers interconnected by one-way valves. Means is provided to periodically vary the volume of the work chamber thereby to induce transfer of fluid through the work chamber from the inlet to the outlet chamber. Also disclosed is a method of removing sludge from a sludge collection pit by periodic variation of the volume of an enclosed chamber in communication with the pit and with a chosen disposal site.

2 Claims, 2 Drawing Figures

Figures 1, 2:
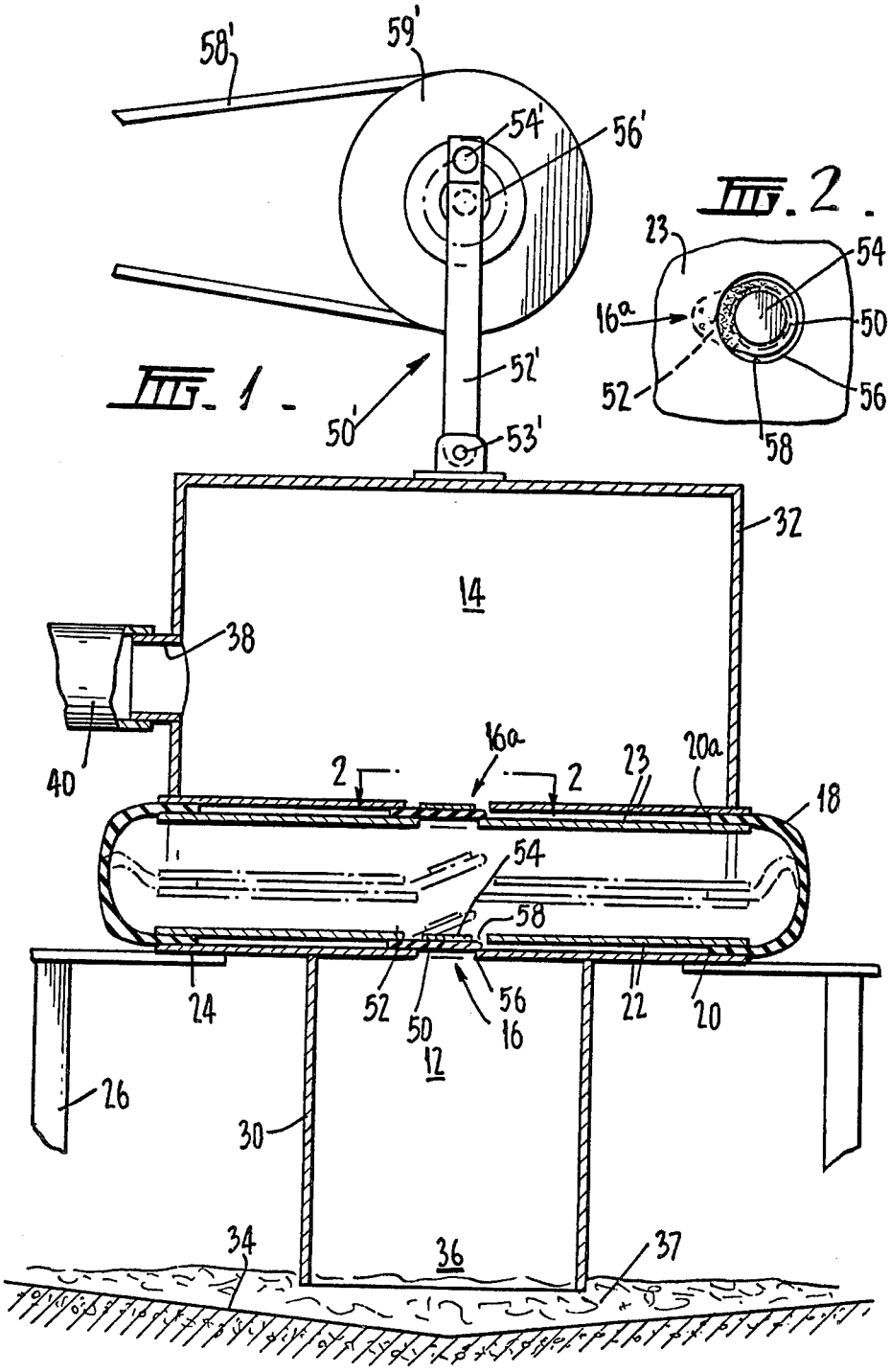

58'
59'
54'
56'
52'
50'
53'

23
54
16a
50
52
56
58
32
14
38
40
16a
2
2
23
20a
18
54
58
24
52
50
56
16
12
22
20
26
30
34
36
37

FLEXIBLE WALL PUMP

This invention relates to pumps and particularly, though not exclusively, to pumps and fluid pumping techniques utilized in the removal of sludge or excretory waste from animal sheds.

Milking sheds must be kept clean and hygienic and an important facet of this work is the pumping way of waste fluid, or "sludge", primarily urine together with some manure, which is deposited by the dairy herd while it is housed in the shed during the milking operation. The conventional practice is to provide a milking shed with floors which slope to a concrete sludge collection pit at one edge or corner of the shed from where the sludge is pumped away by a pump which is typically of the centrifugal variety.

It is an object of the present invention to provide an improved pump for and method of removing the sludge which collects in such pits.

In one aspect, the invention accordingly provides a sludge pump comprising a casing defining an enclosed work chamber, which casing is at least partially flexible whereby to allow variation of the volume of the chamber, respective pressure sensitive one-way inlet and outlet ports providing fluid-flow communication between the work chamber and respective inlet and outlet chambers disposed exteriorly of the work chamber and means to act on the casing to periodically vary the volume of the work chamber.

The pump is preferably mounted on a framework or other base for supporting the pump above a ground surface. When the pump is actually mounted above such a ground surface the fluid inlet chamber is arranged to extend to an opening at or closely adjacent the surface.

The outlet chamber is preferably enclosed and includes means to allow withdrawal of fluid deposited therein from the work chamber.

The means to act on the casing to vary the volume of the work chamber may include a crank drive arrangement.

The casing may comprise a pair of spaced apart substantially rigid wall portions and a continuous flexible wall portion. The substantially rigid wall portions preferably comprise a pair of metal plate members the edges of which are joined by the continuous flexible wall portion, which may, in section, exhibit a U-shape between closest points on the peripheral edges of the respective plates.

In a second aspect, the invention provides a method of removing sludge from a sludge collection pit of an animal support surface comprising the steps of:

reducing the volume of an enclosed chamber placed in receptive communication with the sludge in the pit so as to irreversibly expel the bulk of the contents of the chamber from the chamber;

increasing the volume of the thus reduced chamber whereby to irreversibly draw sludge into the chamber from the pit;

and then reducing the volume of the chamber to expel the sludge contained in the chamber along an outlet line for collection or removal at a chosen location.

The invention will now be described by way of example only with reference to the accompanying drawings, in which:

FIG. 1 is a vertical section through a sludge pump mounted over a sludge collection pit and constructed in accordance with the invention and FIG. 2 is a section on the line 2—2 in FIG. 1.

The illustrated pump includes a variable volume work chamber 10 which communicates via respective pressure sensitive one-way valves 16, **16*a* with an inlet chamber 12 and an outlet chamber 14. Work chamber 10 comprises a flexible annular rubber tyre 18, which defines a pair of oppositely disposed circular openings 20, 20*a*. These openings are closed by respective pairs 22, 23** of circular metal plates. The plates of each pair are bolted together so as to clamp the adjacent inner tyre rim between them.

One-way valves 16, **16*a* (described in detail hereinafter) are centred in plate pairs 22, 23 respectively and the inlet and outlet chambers 12, 14 are defined by respective tubular casings 30, 32 which extend symmetrically outwardly of the appropriate plate pair to which they are welded. Outlet casing 32 has a diameter about twice that of inlet casing 30**.

The plates 22 containing the inlet valve 16 are secured, as, for example, by bolting, to a cross frame 24 supported by a plurality of legs 26 which, in use of the pump and as illustrated, support the cross frame generally horizontally above a concrete pit 34 to be desludged. The casing 30 defining inlet chamber 12 then extends downwardly to open at 36 closely adjacent the surface of the pit where it will be in receptive communication with sludge 37 in the pit during operation of the pump, pit 34 being such that it slopes to a lowest point immediately below port 36.

The casing 32 defining outlet chamber 14 extends a substantial distance above the work chamber 10 and is closed off at its upper end to provide on air dome or cushion above a lateral fluid outlet port 38. Port 38 is provided adjacent the lower end of casing 32 for attachment to a flexible hose 40 suited to conveying sludge deposited in chamber 14 away from the site of the pit for disposal or treatment at a location remote from the pit.

A crank drive arrangement 50' is coupled to casing 32 and is arranged, on being suitably coupled to a motor (not shown), to oscillate this casing 32 vertically between a condition (ghost lines in FIG. 1) in which plates 23 are brought virtually into contact with plates 22 and a condition (full lines in FIG. 1) in which the plate pairs are well separated. The crank drive arrangement includes a crank arm 52' extending upwardly from a pivotal connection at 53' to casing 32. Arm 52' is freely pivotably coupled to a stub shaft 54' which is welded in turn to the curved surface of a crank shaft 56' with the axes of the respective shafts arranged mutually parallel but offset from each other. Crank shaft 56' is driven from the aforementioned motor by a transmission including a continuous V-belt 58' which engages a pulley 59' fixedly mounted on the shaft.

On the first downstroke of crank arm 52' at the commencement of operation of the pump, valve 16 is closed by the greater pressure within chamber 10 and air and other foreign matter in the chamber is expelled through valve **16*a* into chamber 14. On the succeeding upstroke, valve 16*a* is closed by the greater pressure in chamber 14 and sludge is drawn up casing 30 from the pit 34 through valve 16 into chamber 10. On the second downstroke, most or all of the sludge now contained in chamber 10 is forced through valve 16*a* for removal along hose 40. The cycle is then repeated until the sludge is virtually all removed, but it will be noted that the pump may usefully be kept operating if desired in order to clear the full length of line 40**.

This is one of the significant advantages of the illustrated pump both the discharge line, which may in some cases be two or three hundred feet long, and the pump chambers, can be fully cleaned by the pump itself, whereas previously known pumps could not as a rule be used to this end.

It will be noted that the action of the crank arm 52' is such that the casing 32 and plates 23 will rock back and forth during the pumping operation. This action is believed to assist in off-setting the occurrence of "knock" in the apparatus. The appearance of "knock" does nevertheless appear to limit the maximum attainable speed of the pump to about 45 to 50 cycles per minute.

The one-way valve 16, which is identical to valve **16*a*, will now be described in greater detail. The valve comprises a circular rubber pad 50 provided with an integral tab 52, which is in turn secured between the plates 22. The pad is reinforced by a rigid metal facing disc 54 and, in its closed condition, extends across an aperture 58 in the plates 22 to rest on a rim 56 provided by the lower plate of the pair. The valve opens when pad 50 bends upwardly about the tab 52** on application of an appropriate pressure differential.

The above described pump has a number of important advantages. It is both simple and economical in construction, operation and maintenance and yet has proven highly effective. As already mentioned, clearing and cleansing of the pump chambers and associated disposal lines is readily and simple achieved. Furthermore, apart from an easily replaced inlet casing section, the pump is kept well clear of the sludge pool itself between pumping operations, a feature which, in view of the high acidity and consequential corrosive power of bovine urine, is of considerable importance in the long-term. A still further advantage is that the slow motion of the pump and the provision of a part rubber casing both assist, in lessening wear of the pump parts by the sand usually present on the floors of sludge pits.

I claim:

1. A sludge pump having a casing defining a variable volume enclosed work chamber having a pair of spaced apart plates forming a separation therebetween, each of said plates being one of two closely spaced circular plate segments; and an endless flexible wall portion being formed broader than said separation formed by said plates and joining the respective edges of said plates said flexible wall portion being clamped between said plate segments; said plates as joined defining a U-shaped cross-section between closest points on the peripheral edges of said respective plates; pressure sensitive one-way inlet and outlet ports disposed in said respective plates, which ports are opposite to one another being urged into position by flexible flaps seated between the respective sets of said plate segments; said ports providing fluid-flow communication between said work chamber and respective inlet and outlet chambers disposed exteriorly of the work chamber;

means acting on said casing for periodically varying the volume of the work chamber; said pump being further defined by: said inlet and outlet chambers being bounded by respective first and second wall structures secured to associated structures of said plates, said first wall structure extending directly to an opening opposite said respective plate and said inlet port therein, whereby said opening and said inlet and outlet ports are substantially in line, and the outlet chamber being wholly enclosed except for an outlet opening therefrom, being so disposed relative to the respective plate to which the second wall structure is secured, to form an air dome outwardly of said outlet opening; and wherein said means acting on said casing being coupled to the center of the said second wall structure is in line with said one-way inlet and outlet ports for rocking back and forth said second wall structure, said air dome and said plate to which said second wall structure is attached, about a horizontal axis while periodically varying the volume of said work chamber.

2. A pump as claimed in claim 1, wherein: said pump being supported above a sludge collection recess in the floor of a substrate.

* * * * *